United States Patent [19]

Sams et al.

[11] Patent Number: 4,614,071

[45] Date of Patent: Sep. 30, 1986

[54] BUILDING BLOCKS

[76] Inventors: Carl R. Sams, 1377 Catalpa St.; William G. Stivers, 52489 Butternut, both of Rochester, Mich. 48063

[21] Appl. No.: 552,362

[22] Filed: Nov. 16, 1983

[51] Int. Cl.[4] ..... E04C 1/40

[52] U.S. Cl. ..... 52/309.12; 52/405; 52/592

[58] Field of Search ..... 52/405, 309.12, 593, 52/806, 592, 589, 286, 436, 437, 438, 439, 425, 426, 309.9, 606

[56] References Cited

U.S. PATENT DOCUMENTS

| | | | |
|---|---|---|---|
| 979,913 | 12/1910 | Ault | 52/286 |
| 1,282,090 | 10/1918 | Lemme | 52/286 |
| 1,995,264 | 3/1935 | Mason | 52/589 |
| 2,902,733 | 9/1959 | Justus | 52/593 |
| 3,204,581 | 9/1965 | Perreton | 52/309.12 |
| 3,292,331 | 12/1966 | Sams | 52/309.12 |
| 3,552,079 | 1/1971 | Mortensen | 52/593 |
| 3,600,864 | 8/1971 | Godley | 52/314 |
| 3,653,170 | 4/1972 | Sheckler | 52/309.12 |
| 3,719,016 | 3/1973 | Randolph | 52/593 |
| 3,760,548 | 9/1973 | Sauer | 52/593 |
| 4,473,985 | 10/1984 | Hunt | 52/593 |
| 4,475,326 | 10/1984 | Hanson | 52/286 |

FOREIGN PATENT DOCUMENTS

| | | | |
|---|---|---|---|
| 165423 | 2/1950 | Austria | 52/592 |
| 2440466 | 4/1976 | Fed. Rep. of Germany | 52/405 |
| 200583 | 1/1939 | Switzerland | 52/592 |

*Primary Examiner*—John E. Murtagh

*Attorney, Agent, or Firm*—Learman & McCulloch

[57] ABSTRACT

A building block having a six-sided body formed of rigid, foamed, resinous, fire retardant material is bonded on two opposite sides to concrete slabs. Parallel, spaced apart grooves are provided between the body and the slabs and extend along one side of the body and parallel, spaced apart projections are provided between the body and the slabs and extend along another side of the body. The grooves and the projections of each block are so located relatively to the grooves and projections of another block as to interfit with the latter, thereby enabling a wall of any desired length and height to be constructed by interfitting the blocks of each row and course with adjacent blocks. Each of the blocks has one or more openings therein through which a stabilizing and reinforcing member may extend, thereby enabling a wall to be constructed of such blocks without necessitating the use of mortar.

8 Claims, 12 Drawing Figures

BUILDING BLOCKS

BACKGROUND OF THE INVENTION

This invention relates to building blocks of the kind utilized in the construction of exterior and interior walls of a building.

It is commonplace to construct building walls from concrete or other masonry blocks. Adjacent blocks conventionally are adhered to one another by a cementitious mortar. The use of such blocks and mortar in the construction of building walls has several disadvantages. For example, the blocks are heavy, have poor thermal insulating characteristics, and require the services of skilled workmen. Further, the blocks, the mortar, or both, may be quite porous, thereby enabling moisture to seep through a wall composed of such blocks. In addition, the mortar is subject to deterioration requiring periodic repair or replacement.

The disadvantages of using conventional masonry blocks have been recognized heretofore and numerous proposals have been made for overcoming such disadvantages to some extent. Typical of such blocks are those disclosed in Sabuni U.S. Pat. No. 3,247,294; Sams U.S. Pat. No. 3,292,331; Zatchar U.S. Pat. No. 3,299,499; Scheckler U.S. Pat. No. 3,653,170; Piotsa U.S. Pat. No. 3,984,957; Pearlman U.S. Pat. No. 4,075,808; Jones U.S. Pat. No. 4,185,434; and Longinati U.S. Pat. No. 4,234,634. Notwithstanding all of these proposals, however, the construction industry still lacks light-weight building blocks having excellent thermal insulating properties, fire retardant properties, and interlocking capabilities enabling the erection of walls without necessitating the use of mortar. Further, the industry also lacks blocks having the properties recited and which also are decorative in appearance and adapted for use not only for the construction of exterior walls, but for the construction of interior walls as well. Blocks constructed in accordance with the invention overcome the deficiencies of the prior art blocks.

SUMMARY OF THE INVENTION

A building block constructed in accordance with a preferred embodiment of the invention comprises a parallelopiped, form-stable body of molded, foamed, resinous, waterproof material having excellent thermal insulating properties and sandwiched between a pair of masonry slabs. Preferably, those sides of the slabs which confront the body are concave to nest with the body. Each slab includes ribs which extend beyond the confines of the body along one face and one end, and grooves are formed between the body and the slabs at the opposite face and the opposite end to accommodate the ribs of adjacent blocks and provide an interfitting or interlocking connection between adjacent blocks. The interfitting of adjacent blocks makes it possible to dispense with the use of mortar to secure one block to another.

The body of each block preferably has a pair of openings therein and such openings are so spaced that openings in vertically stacked blocks will be in vertical alignment. This makes possible the filling of one set of openings with a reinforcing rod and/or concrete, whereas the other opening in each block may accommodate wiring, piping or the like.

The slabs of a block may be molded so as to present a planar surface or a textured surface, such as the representation of bricks. Further, either or both of the slabs may be equipped with a bonded, stucco-like coating.

If desired, a slab at one side or the other of a block may be provided with grooves in its side for the accommodation of ribs projecting from one end of another block that is to be laid against and extend at a right angle to the one block. In this manner the interior walls of a building may be interlocked with an exterior wall or with another interior wall.

DESCRIPTION OF THE DRAWINGS

The foregoing and other characteristics of blocks constructed in accordance with the invention are referred to in more detail in the accompanying description and are illustrated in the accompanying drawings, in which.

DETAILED DESCRIPTION

Figure 1:
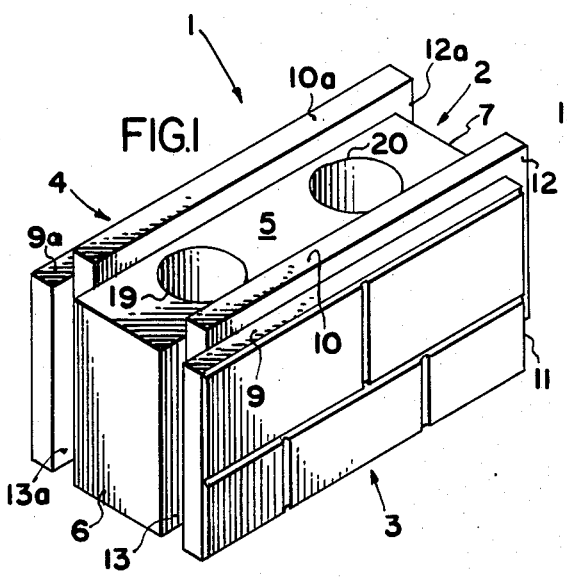
FIG. 1 is an isometric view of a typical block.
Figure 2:
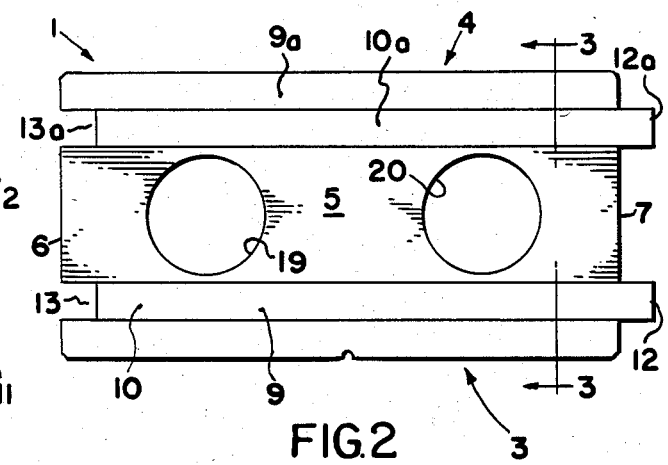
FIG. 2 is a top plan view of the block shown in FIG. 1.

A building block constructed in accordance with the embodiment shown in FIGS. 1–4 is designated generally by the reference character 1 and comprises a parallelopiped, six-sided body 2 sandwiched between and bonded to two slabs 3 and 4. The body preferably is formed of a rigid, foamed, resinous material such as polyurethane, polystyrene, or the like which has excellent thermal insulating characteristics. Preferably, the material from which the body is made includes a fire-retardant, low smoke substance having a Class I rating by Underwriter's Laboratories, Inc. An acceptable fire-retardant material is that designated 864Z produced by Foamseal, Inc., of Oxford, Mich., and described in its specification dated Dec. 15, 1982.

The body 2 has a flat or planar upper surface 5 and planar end surfaces 6 and 7. The bottom surface 8 (FIG. 3) also is flat and parallel to the upper surface 5.

Figure 3:
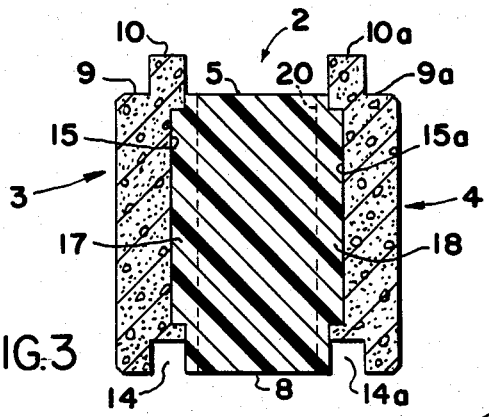
FIG. 3 is a sectional view taken on the line 3—3 of FIG. 2.

The slab 3 is a unitary member molded from a suitable fire resistant aggregate and cement having an outer surface terminating at its upper end in a flat ledge 9 from which projects an upstanding rib 10. At one end the slab terminates in a vertical surface 11 beyond which projects a vertical rib 12 which forms at its upper surface a continuation of the rib 10. At its opposite end the slab 3 has a vertical recess or groove 13. A similar groove 14 extends along the bottom of the slab 3 as is best shown in FIG. 3.

The slab 4 corresponds in construction to that of the slab 3 and corresponding parts are indicated by corresponding reference characters, followed by the suffix a.

Figure 4:
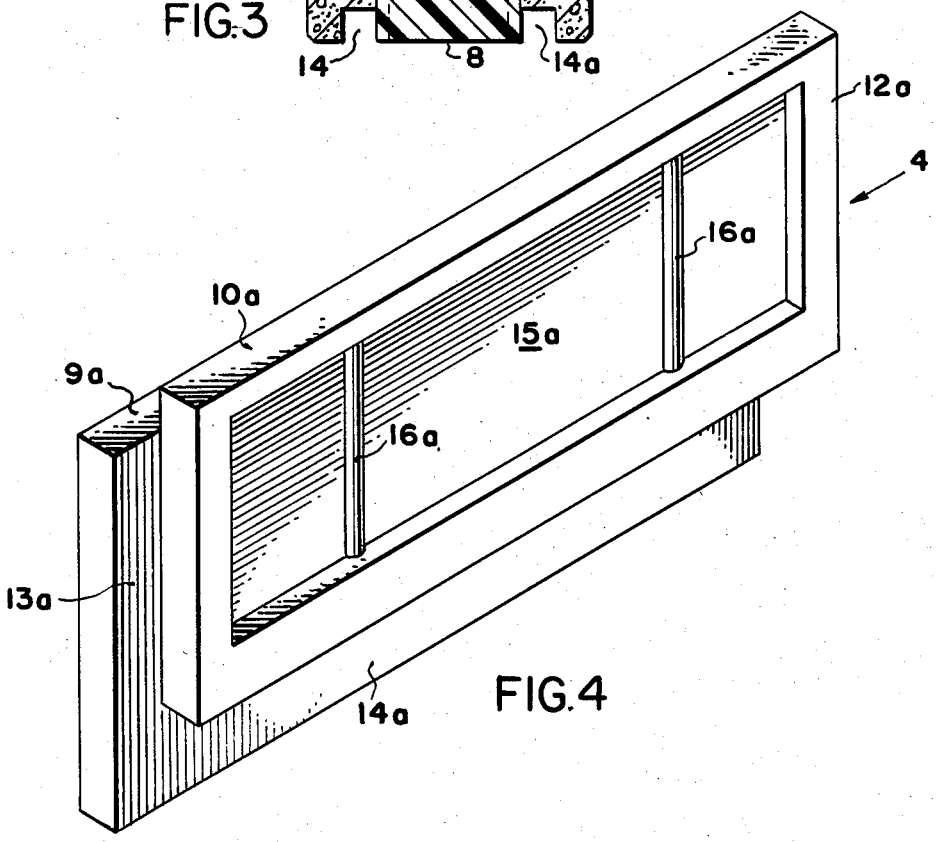
FIG. 4 is an isometric view of the inner surface of a slab at one side of the block.

The inner surface of the slab 3, i.e., the surface which confronts the body 2, is provided with a concave recess 15, and a similar recess 15*a* is formed in the inner surface of the slab 4. Preferably, vertically extending strengthening ribs are provided on the inner surfaces of the slabs 3 and 4. Such ribs are shown in FIG. 4 and are represented by the reference character 16*a*.

The slabs 3 and 4 may be precast in a conventional concrete block molding machine. The slabs 3 and 4 then may be placed in spaced apart relation in a mold cavity of a foamed plastic molding machine (not shown) and a charge of foamable plastic material introduced to the cavity so as to fill the mold cavity and form the body 2. The plastic material will enter the recesses 15, 15*a*, and form on opposite sides of the body convex portions 17 and 18 which nest in the cavities.

The mold is so shaped that the bottom 8 of the body 2 is flush with the lower ends of the slabs 3 and 4, whereas the upper side 5 of the body lies below the upper edges of the slabs 3 and 4 to form the ribs 10 and 10*a* that are so spaced from one another and are of such size as to be accommodated snugly in the grooves 14 and 14*a* of the lower surface of another block like the block 1.

Prior to the body molding process the recesses of the slabs may be coated with a suitable, conventional bonding material to which the foamed plastic will adhere. Alternatively, the body and the slabs may be formed from known materials which are self-adhering.

The mold cavity of the molding machine is provided with conventional, spaced apart members which enable the molded body 2 to have a pair of spaced, parallel openings 19 and 20 extending therethrough.

As has been mentioned, at one end of each of the blocks 1 is a pair of vertical grooves 13, 13*a* and at the opposite end of each block is a pair of projections 12, 12*a*. These grooves and projections are so spaced and sized that the projections at one end of one block may be snugly accommodated in the grooves at the confronting end of an adjacent, corresponding block.

Blocks like the block 1 may be arranged end-to-end with the projections 12, 12*a* of each block snugly accommodated in the grooves 13, 13*a* of the next adjacent block so as to form a horizontal row of blocks. Atop the first row of blocks may be laid a second row or course of blocks with the upper projections 10, 10*a* of each lower block being snugly accommodated in the grooves 14, 14*a* in the lower surface of the next adjacent higher block. It is contemplated that the blocks of adjacent courses will have their ends offset from one another, as is conventional, and the amount of offset should be such that the openings 19 and 20 of each block in a higher course will be aligned vertically with the opening 19 or 20 in two of the next adjacent lower blocks, as also is conventional.

Figure 5:
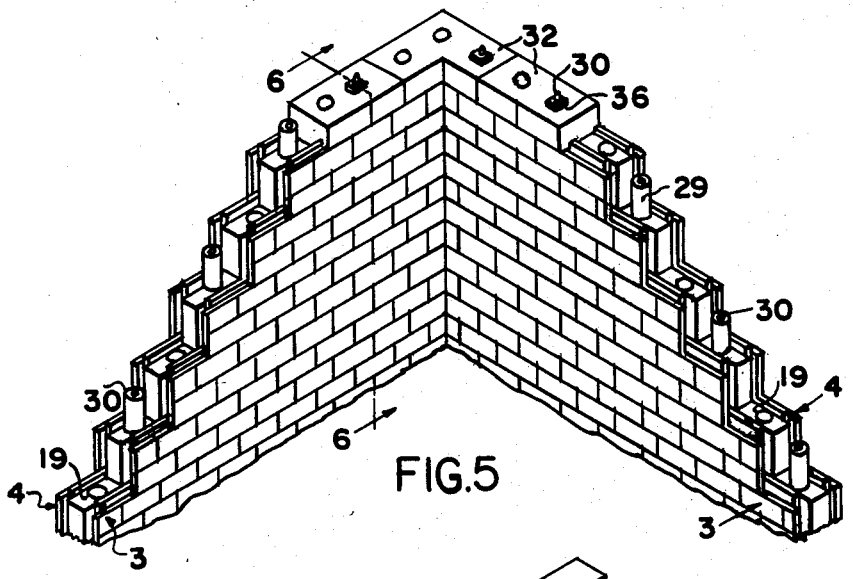
FIG. 5 is an isometric view illustrating a partial wall constructed with blocks of the kind shown in FIG. 1.
Figure 6:
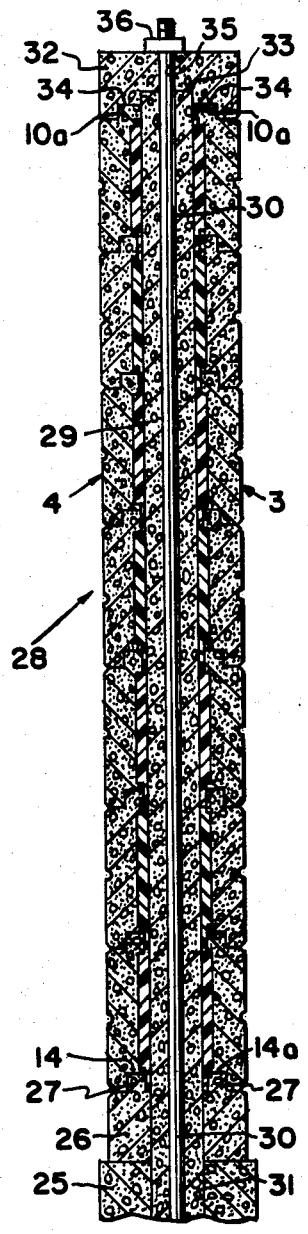
FIG. 6 is a fragmentary, sectional view, taken on the line 6—6 of FIG. 5.

In the construction of a wall such as that shown fragmentarily in FIG. 5, the contractor provides a foundation 25, as shown in FIG. 6, on the upper surface of which is fixed a bottom or base block 26. The base block is composed of molded concrete and has spaced, parallel ribs 27 at its upper surface which may be accommodated in the grooves 14, 14*a* of the blocks 1 forming the lowermost course. The base blocks 26 are arranged in end-to-end, abutting relation to form a horizontal row. If desired, the confronting ends of the adjacent base blocks 26 may have longitudinally extending projections accommodated in correspondingly spaced grooves.

Atop the base block 26 is laid a first course of horizontally extending blocks 1, following which a second course of blocks 1 is laid atop the first course, and so on until a wall 28 of the desired height is constructed. As is conventional, the blocks of each course are offset or staggered so that the joints between adjacent blocks of each course are not vertically aligned. The spacing between the blocks of each adjacent course should be such that an opening 19 in a higher course block will be in vertical alignment with an opening 20 in a lower course block. It thus will be possible to fill one set of vertically aligned openings with a reinforcing column 29 of concrete. If desired, a reinforcing steel rod 30 may be embedded in the concrete column, and preferably both the column and the rod extend into an opening 31 formed in the foundation 25. The upper ends of the column 29 and the rod 30, if used, preferably extend beyond the upper course of blocks.

The upper surface of the wall 28 may be finished by means of a top cap block 32 having a central recess 33 for the accommodation of the upper ends of the concrete columns 29 and grooves 34 for the accommodation of the ribs 10, 10*a* of the blocks of the top course. In addition, a top cap block 32 has an opening 35 for the passage of the upper end of the reinforcing rod 30. The end of the rod 30 is threaded for the accommodation of a nut 36. If desired, the opposite ends of the top cap block 32 may be provided with projections and grooves so that each adjacent block 32 may have its projections accommodated in the grooves of the adjacent block.

Figure 7:
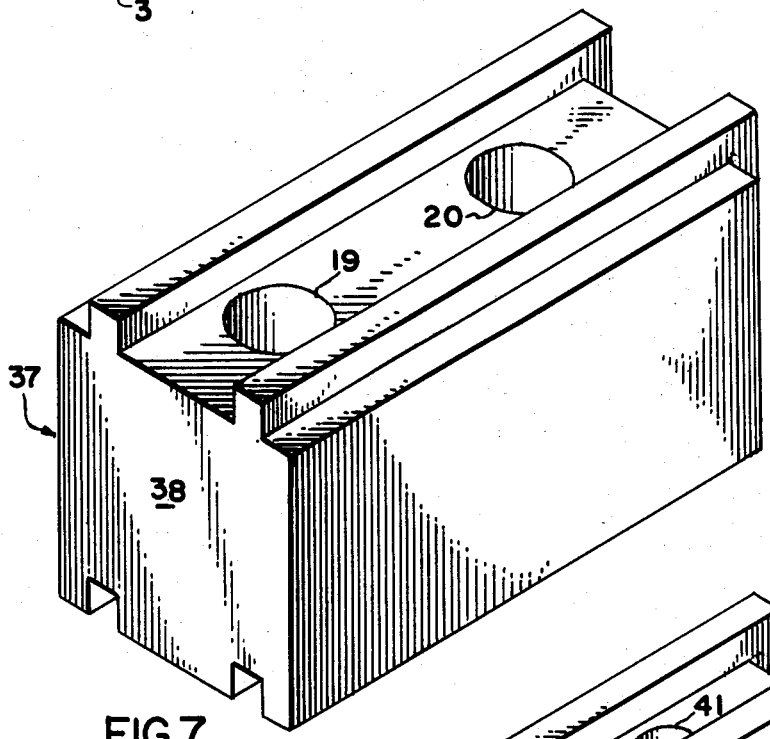
FIG. 7 is an isometric view of a block adapted to be used at one end of a course of blocks of a wall.
Figure 8:
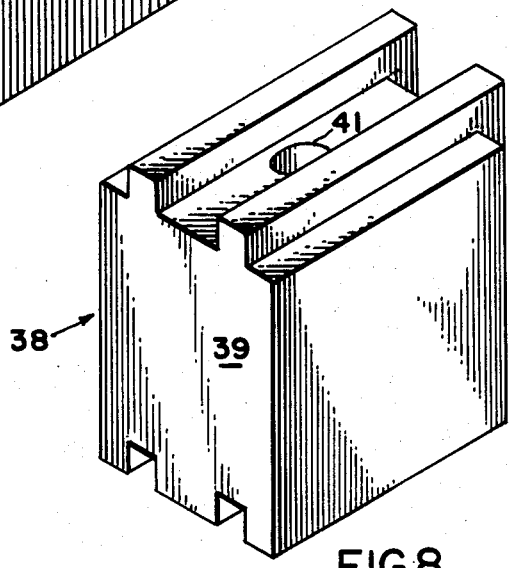
FIG. 8 is an isometric view of another block adapted to be used at one end of a course of blocks.

At an end of each course of blocks the exposed end of the endmost block should have a flat or planar surface. If the blocks in adjacent courses are staggered in a so-called half-bond manner, as is conventional, the endmost blocks in vertically adjacent courses will alternately be full size and half size. A full size end block is shown at 37 in FIG. 7 and a half size block is shown at 38 in FIG. 8. The block 37 is formed wholly of concrete and has a flat end 39, but otherwise the block corresponds to the blocks 1. The block 38 is formed wholly of concrete and has one flat end 40, but otherwise has ribs and grooves corresponding to the blocks 1 and one opening 41 spaced to be aligned with the openings 19 and 20 of higher and lower blocks.

The interfitting of the adjacent blocks with one another, coupled with the use of the reinforcing columns and rods, makes it unnecessary to utilize any mortar in the erection of a wall. If desired, however, a thin layer of suitable adhesive, preferably of a waterproof composition, may be applied to the joints between adjacent blocks.

The interfitting of the blocks not only results in an exceedingly strong, weather proof wall, but also makes it virtually impossible for flames to reach the plastic body 2.

It sometimes is desirable to construct an interior wall from blocks similar to the block 1. If it also is desired to interlock the blocks of the interior wall with one another and with the blocks of the external wall, then three blocks of slightly modified construction will be required. The three blocks are illustrated in FIGS. 9–12.

Figure 9:
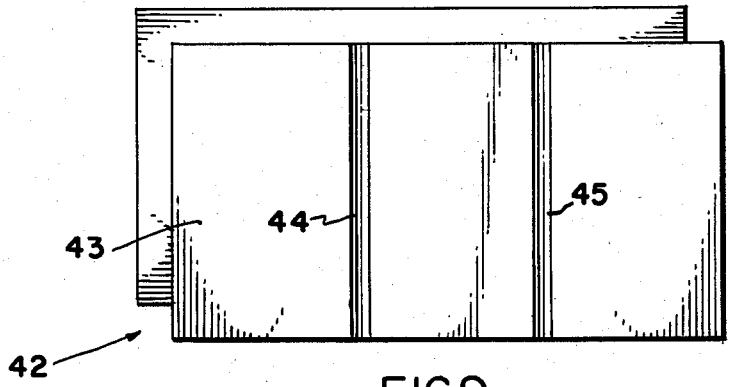
FIG. 9 is an elevational view illustrating a block having a modified slab at one side thereof.

The block 42 shown in FIG. 9 is like the block 1 with the exception that one of its two slabs 43 has between its ends a pair of vertical, parallel grooves 44, 45 in its outer surface. The spacing between the grooves corresponds to that between the end ribs 12, 12*a* of a block 1 and the depth of each groove 44, 45 corresponds to the height of such ribs. Thus, the ribs 12, 12*a* at one end of a block 1 may be accommodated in the grooves 44, 45.

Figure 10:
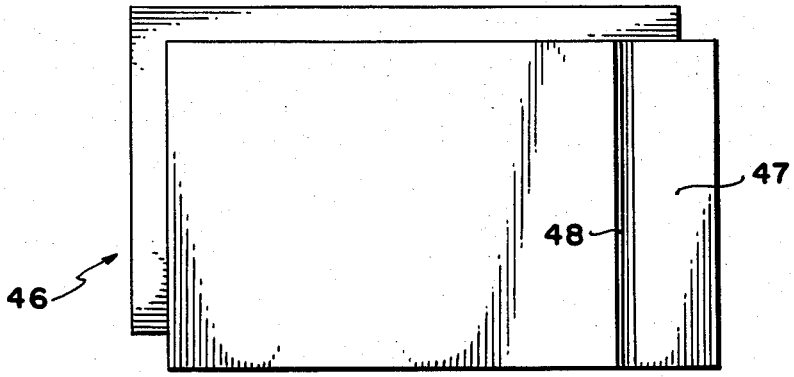
FIG. 10 is an elevational view of another block having a modified slab at one side.

The block 46 shown in FIG. 10 also is like the block 1 with the exception that one of its two slabs 47 has between its ends a vertical groove 48 adjacent one end of the slab. This groove corresponds to the width and height of the ribs 12, 12*a* of a block 1, but the spacing of the groove from the adjacent end of the block 46 corresponds to only one-half the spacing between the ribs 12, 12*a* of the block 1.

Figure 11:
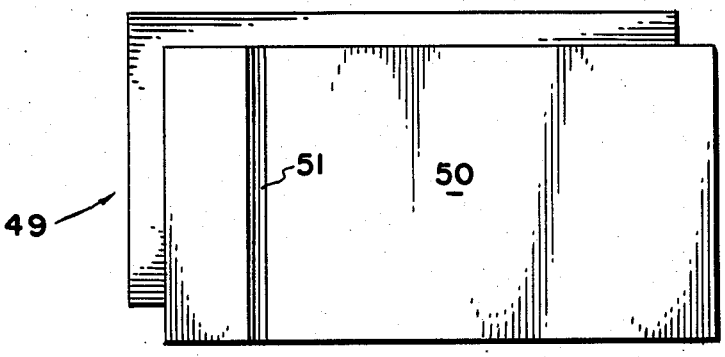
FIG. 11 is a view similar to FIG. 10, but illustrating a block having a further modified slab.

The block 49 shown in FIG. 11 is like the block 46 in that one of its slabs 50 has a vertical groove 51 adjacent one end which corresponds to the groove 48. The difference between the blocks 46 and 49 is that the respective grooves 48 and 51 are located in mirror image relation so that, when two such blocks are placed end to end, the grooves 48 and 51 are spaced apart a distance corresponding to that between the ribs 12, 12*a* at one end of a block 1.

Figure 12:
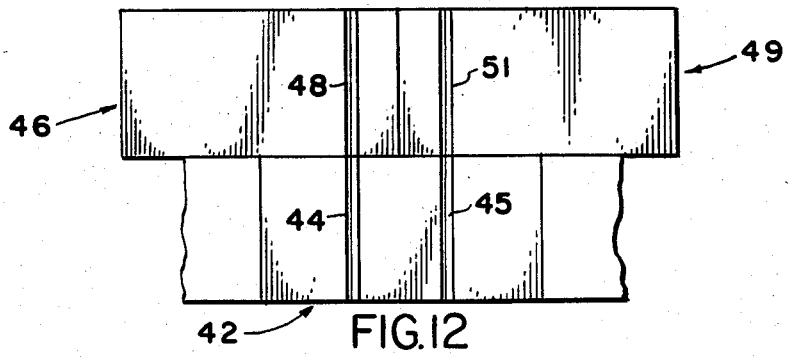
FIG. 12 is a fragmentary, elevational view of a portion of a wall formed of blocks like those shown in FIGS. 1 and 9–11.

When it is desired to construct a wall at right angles to another wall, a block 42 may be interposed between two blocks 1 of the lowermost course, as is shown in FIG. 12 thereby enabling another block 1 (not shown in FIG. 12) normal to the block 40 to have its end ribs 12, 12*a* accommodated in the grooves 44, 45. A pair of blocks 46 and 49 of a second course may be placed atop the block 42 with their adjacent ends abutting each other. The grooves 48 and 51 will be spaced apart a distance to accommodate the ribs 12, 12*a* of another block 1 (or a half-length block like the block 1, but having only one core opening rather than two) and with the abutting ends of the blocks 46 and 49 located between the grooves 44, 45 of the lower block 1. This procedure may be repeated until a wall of the desired height has been constructed.

The disclosure is representative of presently preferred embodiments of the invention, but is intended to be illustrative rather than definitive thereof. The invention is defined in the claims.

We claim:

1. A building block comprising a six-sided, parallelepiped body formed of rigid, foamed resinous material having thermal insulating and fire retardant properties, said body having flat upper and lower surfaces, flat opposite ends, and laterally extending, convex projections at two opposite sides; a pair of masonry slabs each of which has an inner, concave surface and an outer surface; and means securing said slabs to said body on said opposite sides of the latter with the inner surfaces of said slabs embracing said projections and adhered to the respective opposite sides of said body, said slabs having external, parallel, bottom grooves extending the full length of the lower surface of said body and external, parallel, end grooves extending the full height of one end of said body, with the bodyportion forming part of the end and bottom groove said slabs having integral, external, parallel, top ribs extending above and along the upper surface of said body a distance corresponding to the depth of the bottom grooves adjacent the lower surface of said body, said ribs extending beyond the other end of said body a distance corresponding to the depth of the end grooves adjacent said one end of said body, said slabs having parallel, external end ribs adjacent said other end of said body projecting beyond the latter a distance corresponding to the depth of the grooves adjacent said one end of said body, the relative widths of and spacing between the end grooves and the end ribs at opposite ends of said body and the top ribs and the bottom grooves at the respective upper and lower surfaces of said body being such as to enable the end grooves at said one end of said block to accommodate and abut the end ribs at the other end of a like block and the bottom grooves at the lower surface of said block to accommodate and abut the top ribs at the upper surface of a like block, said body being located wholly within the confines of said slabs.

2. A block according to claim 1 wherein at least one of said slabs has in one side thereof and between its ends a pair of external, laterally spaced, vertical grooves of such height, depth, and spacing as to enable a like block to have its end ribs at said one end thereof snugly fitted into the grooves in said one side of said one of said slabs.

3. A block according to claim 1 wherein at least one of said slabs has in one side thereof and between its ends an external groove having a width and depth corresponding to the width and depth of one of said end ribs at said other end of said body, said groove being spaced from one end of said one side of said block a distance corresponding substantially to one-half the spacing between the ribs at said other end of said body block.

4. A block according to claim 1 wherein each of said slabs terminates flush with the opposite end of said body.

5. A block according to claim 1 wherein said slabs are formed of cement and aggregate.

6. A block according to claim 1 wherein the means securing said slabs to said body comprises an adhesive.

7. A block according to claim 1 wherein said body has a pair of spaced apart openings extending vertically therethrough.

8. A block according to claim 7 wherein each of said openings is uniform in size.

* * * * *

UNITED STATES PATENT AND TRADEMARK OFFICE

CERTIFICATE OF CORRECTION

PATENT NO. : 4,614,071

DATED : September 30, 1986

INVENTOR(S) : Carl R. Sames et al

It is certified that error appears in the above-identified patent and that said Letters Patent is hereby corrected as shown below:

Column 6, line 41, delete "body".

Sigred and Sealed this

Eighteenth Day of August, 1987

*Attest:*

DONALD J. QUIGG

*Attesting Officer*

*Commissioner of Patents and Trademarks*